US012599803B1

(12) United States Patent
Hu

(10) Patent No.: US 12,599,803 B1
(45) Date of Patent: Apr. 14, 2026

(54) FITNESS EQUIPMENT

(71) Applicant: Huaxu Hu, Jinhua (CN)

(72) Inventor: Huaxu Hu, Jinhua (CN)

( * ) Notice: Subject to any disclaimer, the term of this patent is extended or adjusted under 35 U.S.C. 154(b) by 0 days.

(21) Appl. No.: 19/277,399

(22) Filed: Jul. 23, 2025

(30) Foreign Application Priority Data

Jul. 7, 2025 (CN) ..... 202521414854.4

(51) Int. Cl.
*A63B 21/055* (2006.01)
*A63B 21/00* (2006.01)

(52) U.S. Cl.
CPC ..... *A63B 21/0557* (2013.01); *A63B 21/4035* (2015.10)

(58) Field of Classification Search
CPC . A63B 21/04; A63B 21/0407; A63B 21/0414; A63B 21/0442; A63B 21/055; A63B 21/0552; A63B 21/0557; A63B 21/4027; A63B 21/4029; A63B 21/4031; A63B 21/4034; A63B 21/4035; A63B 21/4045; A63B 23/0205; A63B 23/0211; A63B 23/0216; A63B 23/0222; A63B 71/0054; A63B 2071/0063; A63B 2071/0072; A63B 2208/0214; A63B 2208/0219; A63B 2225/09
See application file for complete search history.

(56) References Cited

U.S. PATENT DOCUMENTS 3,620,530 A * 11/1971 Cosby ..... A63B 21/156 482/130
5,222,927 A * 6/1993 Chang ..... A63B 22/0002 482/53
5,295,935 A * 3/1994 Wang ..... A63B 21/4033 482/130
5,700,232 A * 12/1997 Clausen ..... A63B 21/154 482/125
5,911,535 A * 6/1999 Gvoich ..... A63B 23/0482 482/126
6,042,523 A * 3/2000 Graham ..... A63B 22/203 482/79
6,071,217 A * 6/2000 Barnett ..... A63B 21/154 482/121
6,383,122 B1 * 5/2002 Graham ..... A63B 22/0087 482/121
7,008,359 B2 * 3/2006 Fan ..... A63B 22/18 482/146

(Continued)

FOREIGN PATENT DOCUMENTS

FR 2817155 A3 * 5/2002 ..... A63B 22/20
KR 20160031361 A * 3/2016 ..... A63B 21/018

*Primary Examiner* — Gary D Urbiel Goldner
(74) *Attorney, Agent, or Firm* — Jose Cherson Weissbrot

(57) ABSTRACT

The present invention relates to the technical field of fitness equipment, and particularly to fitness equipment including a first main body, a second main body, and a resetting assembly. The second main body is reciprocally movable with respect to the first main body, and the resetting assembly includes an elastic rope and a fixed pulley. The fixed pulley is rotatably connected to the first main body, one end of the elastic rope is fixedly connected to the first main body, and the other end of the elastic rope passes around the fixed pulley and is fixedly connected to the second main body. The technical solution of the present invention aims at improving the durability and service life, and the practicality of the product.

11 Claims, 9 Drawing Sheets

(56) References Cited

U.S. PATENT DOCUMENTS

| | | | | |
|---|---|---|---|---|
| 7,357,766 | B2 * | 4/2008 | Langer | A63B 22/18 482/146 |
| 8,936,539 | B2 * | 1/2015 | Richard | A63B 21/0442 482/130 |
| 9,873,012 | B2 * | 1/2018 | Huppée | A63B 23/0417 |
| 10,426,991 | B2 * | 10/2019 | Barnett | A63B 21/0552 |
| 10,792,528 | B1 * | 10/2020 | Lagree | A63B 21/00065 |
| 11,904,203 | B2 * | 2/2024 | Holman | A63B 21/00065 |
| 11,931,615 | B2 * | 3/2024 | Lagree | A63B 21/00069 |
| 2003/0125173 | A1 * | 7/2003 | Fan | A63B 22/18 482/146 |
| 2007/0054791 | A1 * | 3/2007 | Langer | A63B 21/0004 482/146 |
| 2014/0121076 | A1 * | 5/2014 | Lagree | A63B 21/023 482/123 |
| 2015/0065320 | A1 * | 3/2015 | Anderson | A63B 21/156 482/142 |
| 2016/0296791 | A1 * | 10/2016 | Bailar | A63B 21/0087 |
| 2016/0325137 | A1 * | 11/2016 | Bailar | A63B 21/068 |

* cited by examiner

FITNESS EQUIPMENT

TECHNICAL FIELD

The present invention relates to the technical field of fitness equipment, and particularly to fitness equipment.

BACKGROUND ART

With the popularity of the five-day workweek, more and more people choose gyms for strength training, or exercises such as Pilates to maintain health. In addition, aerobic exercises, such as swimming, walking, jogging, running and indoor cycling, have become common ways of daily exercise. However, conventional fitness equipment can only train a particular muscle group. Therefore, it is necessary to purchase a variety of equipment to fully exercise various parts of the body. This not only results in a high purchase cost, but also occupies a large amount of storage space.

At present, there is some fitness equipment on the market that uses the split-plate design to assist the user in exercising in a variety of postures. However, there are still technical problems with this type of product. First, the conventional exercise machine is generally composed of split plates, and an elastic member is installed at a connection portion so that the plate can be elastically restored in the absence of an external force to cooperate with a user to complete a designated exercise posture. However, these products generally fix both ends of the elastic member directly between two plates, so that the stress concentration of the elastic member causes the elastic member to be easily damaged in the case that the space between the plates is continuously changed, thereby reducing the durability and service life of the product and affecting the practicality of the product.

SUMMARY OF THE INVENTION

It is a primary object of the present invention to provide fitness equipment which is intended to improve the durability and service life of the product as well as improving the practicality of the product.

In order to achieve the above object, the present invention provides an exercise apparatus, including:

a first main body, and a second main body reciprocally movable with respect to the first main body; and a resetting assembly, the resetting assembly comprising an elastic rope and a fixed pulley, wherein the fixed pulley is rotatably connected to the first main body, one end of the elastic rope is fixedly connected to the first main body, and the other end of the elastic rope passes around the fixed pulley and is fixedly connected to the second main body.

In one possible embodiment, a telescopic member is provided between the first main body and the second main body, and the elastic rope passes around the fixed pulley with the telescopic member as a center position.

In one possible embodiment, the first main body is provided with a first limiting member and a first limiting groove, the second main body is provided with a second limiting member and a second limiting groove, the first main body is integrally injection-molded with the first limiting member and the first limiting groove, and the second main body is integrally injection-molded with the second limiting member and the second limiting groove;

two ends of said telescopic member are respectively embedded in the first limiting groove and the second limiting groove; and the first limiting member and the second limiting member are both provided with notches for fixing the elastic rope, and two ends of said elastic rope are respectively embedded in the first limiting member and the second limiting member.

In one possible embodiment, the first main body is provided with a first limiting base plate for preventing the elastic rope from being separated from the first limiting member and the telescopic member from being separated from the first limiting groove;

the second main body is provided with a second limiting base plate for preventing the elastic rope from being separated from the second limiting member and the telescopic member from being separated from the second limiting groove; and the first limiting base plate and the second limiting base plate are fixedly connected to the first main body and the second main body respectively.

In a possible embodiment, a stretching member is detachably and fixedly connected to the first main body, a second handle is fixedly connected to one end of the stretching member, a pulling groove is provided at the edge of the first main body, a locking groove is provided on the lower side of the pulling groove, a limiting protrusion is provided at one end of the stretching member, and the limiting protrusion passes around the pulling groove and is clamped with the locking groove.

In a possible embodiment, a plurality of first insertion holes and a plurality of second insertion holes are respectively provided on the first main body and the second main body;

several first handles which can be inserted into a first insertion hole or a second insertion hole are included, wherein at least two insertion columns for mating with the first insertion hole or the second insertion hole are fixedly connected to a lower side of each of the first handles; and the lower side of each first handle near the insertion column is provided with an annular groove for improving the convenience of installation and removal of the equipment.

In a possible embodiment, the second main body is provided with a slipping wheel group, the slipping wheel group comprises at least two coaxially arranged slipping wheels, the two slipping wheels are respectively located on two sides of the second main body, the slipping wheel group has at least two groups, and the outer diameter of the slipping wheels on the slipping wheel group away from the first main body is greater than the outer diameter of the slipping wheels on the slipping wheel group close to the first main body.

In one possible embodiment, the telescopic member is a rod-like structure, and at least two fixed pulleys are provided; and two fixed pulleys are respectively located at one end of the telescopic member away from the second main body, and are symmetrically arranged with the axis of the telescopic member as a center.

In one possible embodiment, the first main body is covered on its surface and side surface with a first cushion, and the second main body is covered on its surface and side surface with a second cushion; and in addition, a plurality of first intermittent grooves and a plurality of second intermittent grooves are respectively provided on the surfaces of the first cushion and the second cushion.

In one possible embodiment, the first main body is embedded with a digital display screen for displaying the number of times of action or time and a battery module for supplying power to the digital display screen; and the surface of the digital display screen is provided with a charging interface for charging the battery module.

The working principle and beneficial effects of the solution of the present invention are as follows:

according to the technical solution of the present invention, by a relative slipping action of a first main body and a second main body, a user kneels on the first main body, drives the second main body to reciprocate via a lower limb, and thus enables the user to exercise on the abdomen; in this exercise process, whenever the second main body gradually moves away from the first main body, as the distance increases, a reset force applied to the second main body by an elastic rope will also increase, and so the user is enabled to complete an action more easily in cooperation with this force, and auxiliary exercise is thus conducted; then the fixed pulley is provided so that the elastic rope wound on the fixed pulley is under a stretching action; the stretching force is also delivered to the fixed pulley; however, with the rotation of the fixed pulley, the point on the elastic rope subjected to the stretching stress will change with the change of the stretching force; with the changed stress point, when the elastic rope works, the problem of stress concentration is reduced, so that different regions of the elastic rope are all subjected to the stretching force; however, the traditional elastic rope has been stretched in a certain region when being subjected to a force, and in a long-time stretching and resetting, the elasticity of the elastic rope will be reduced, and the elastic rope will also be more easily damaged; and according to the method for the elastic rope to pass around the fixed pulley in the present application, the stability of the structure and the use reliability are enhanced, the tensile force can be effectively dispersed, and thus the overall service life and practicality of the product are improved.

BRIEF DESCRIPTION OF THE DRAWINGS

In order to explain the embodiments of the present invention or the technical solutions in the prior art more clearly, the following will briefly introduce the drawings needed in the embodiments and the prior art. Obviously, the drawings in the following description are only some embodiments of the present invention. For those of ordinary skills in the art, without involving creative efforts, other drawings can be obtained from the structures shown in these drawings.

DESCRIPTION OF REFERENCE NUMERALS

Figure 1:
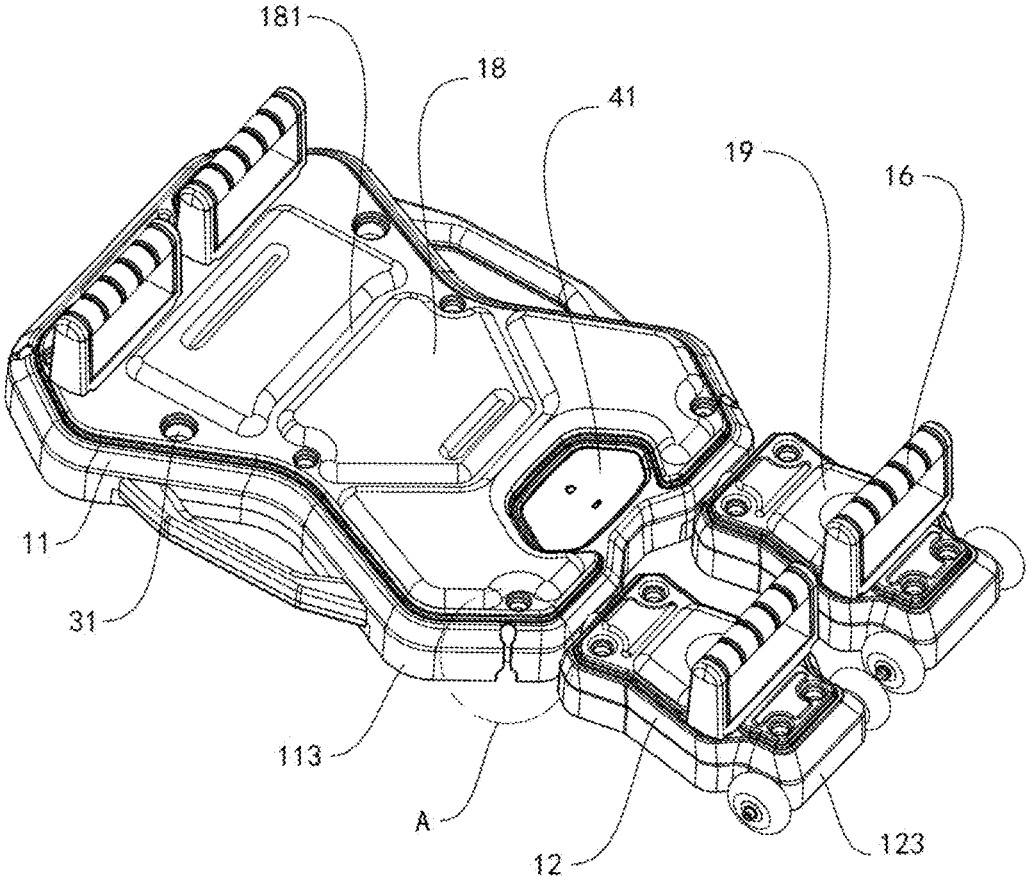
FIG. 1 is schematic view 1 of fitness equipment according to the present invention.
Figure 2:
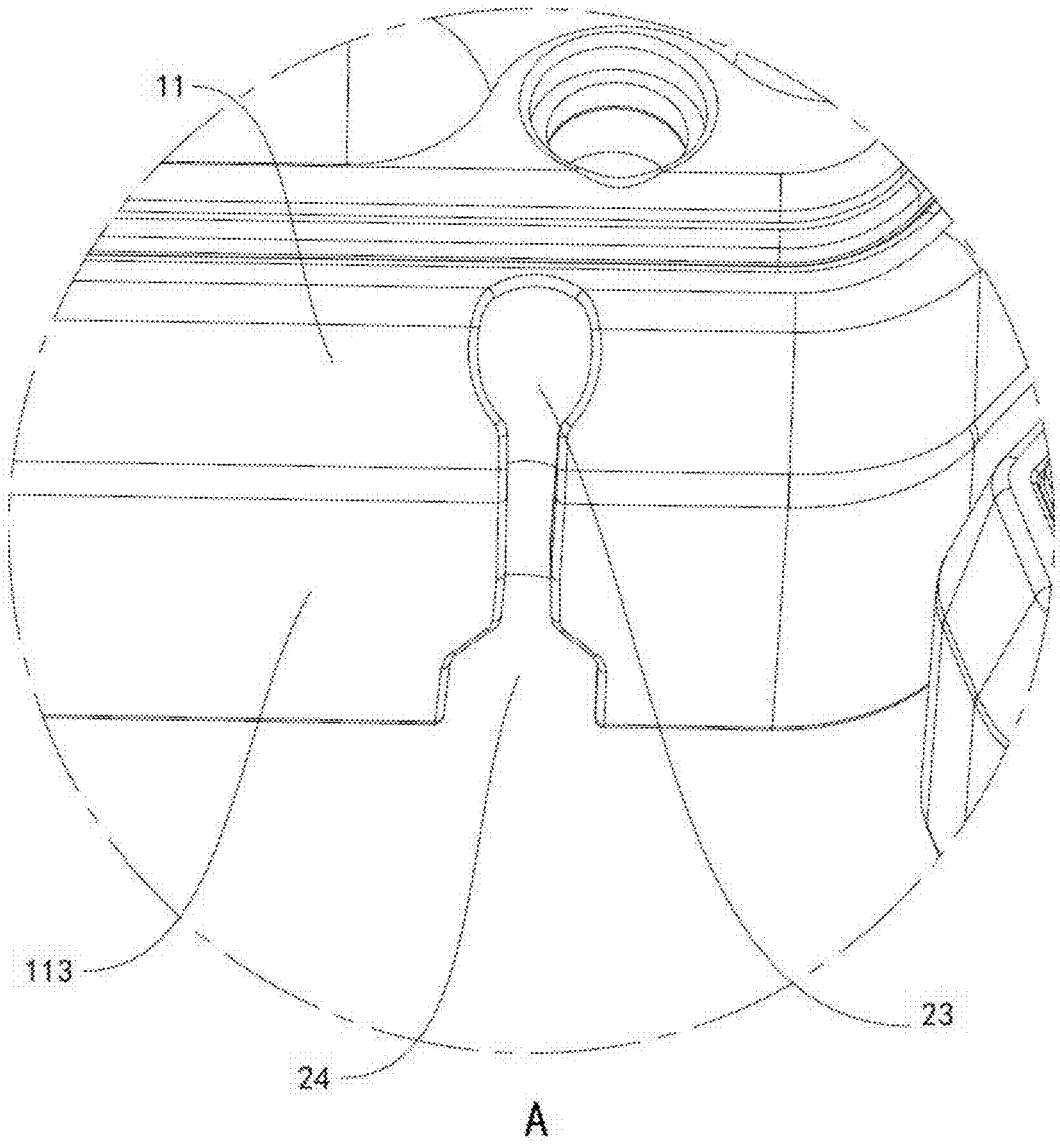
FIG. 2 is an enlarged schematic view at A in FIG. 1.
Figure 3:
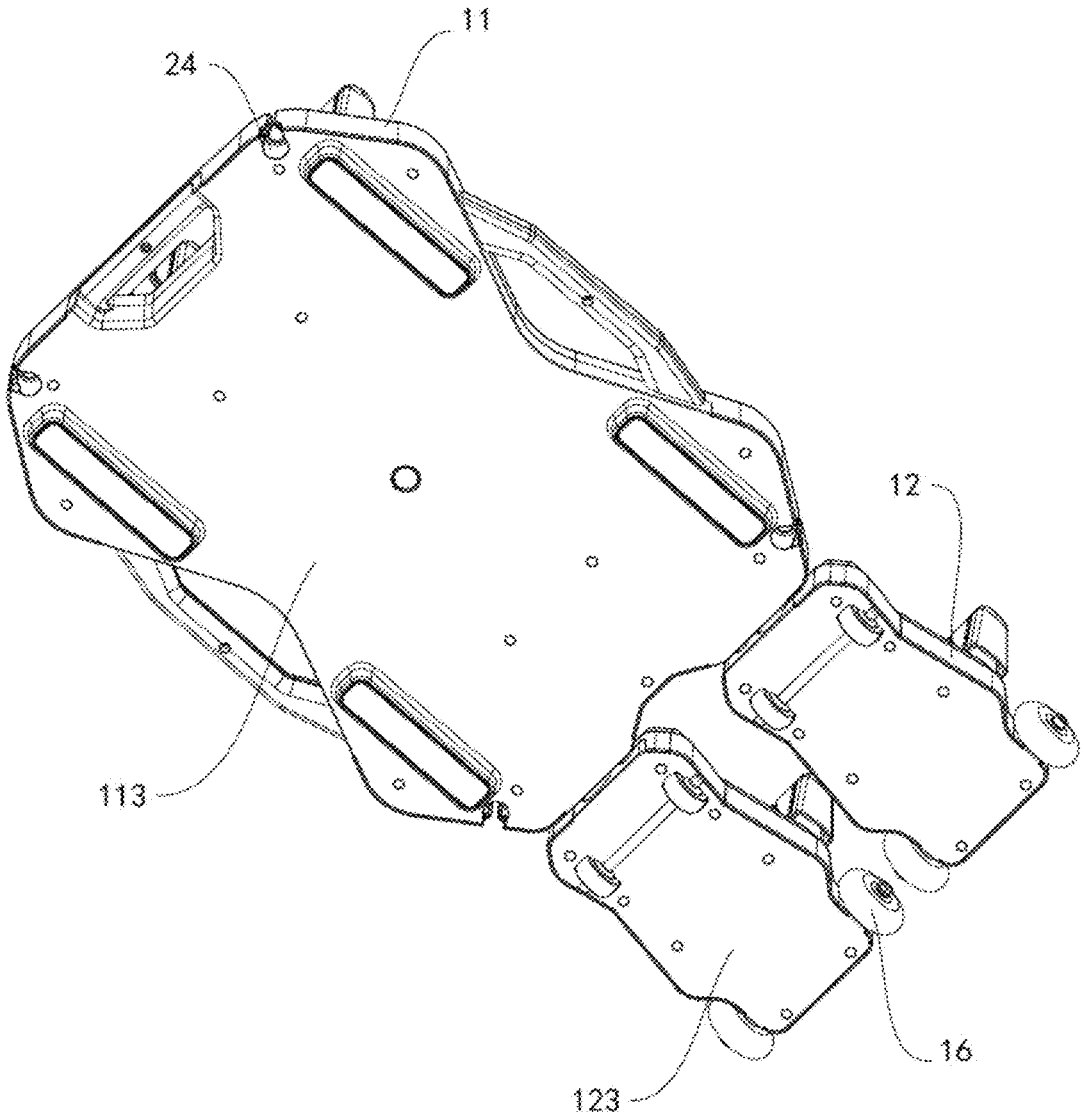
FIG. 3 is schematic view 2 of fitness equipment according to the present invention.

11, first main body; 111, first limiting member; 112, first limiting groove; 113, first limiting base plate; 12, second main body; 121, second limiting member; 122, second limiting groove; 123, second limiting base plate; 13, elastic rope; 14, fixed pulley; 15, telescopic member; 16, first handle; 17, slipping wheel; 18, first cushion; 181, first intermittent groove; 19, second cushion; 191, second intermittent groove; 21, stretching member; 22, second handle; 23, pulling groove; 24, locking groove; 25, limiting protrusion; 31, first insertion hole; 32, second insertion hole; 33, insertion column; 34, annular groove; and 41, digital display screen.

The objects, functional features, and advantages of the present invention will be further described with reference to the accompanying drawings in conjunction with the embodiments.

DETAILED DESCRIPTION OF THE INVENTION

In order to make the object, technical schemes, and advantages of the present application more apparent, a more particular description of the present application will be rendered below with reference to the accompanying drawings and embodiments. It is to be understood that the specific embodiments described herein are merely illustrative of the present application and are not intended to be limiting thereof.

The present invention provides an exercise apparatus.

Embodiment 1

With reference to FIGS. 1 to 9, the fitness equipment includes a first main body 11, a second main body 12 and a resetting assembly, wherein the second main body 12 can perform reciprocating motion relative to the first main body 11, and the resetting assembly includes an elastic rope 13 and a fixed pulley 14. The fixed pulley 14 is rotatably connected to the first main body 11, one end of the elastic rope 13 is fixedly connected to the first main body 11, and the other end of the elastic rope 13 passes around the fixed pulley 14 and is fixedly connected to the second main body 12.

By means of the resetting assembly, the relative reciprocating slipping between the first main body 11 and the second main body 12 can be more stable and achieve resetting; by means of the connection mode of the elastic rope 13 and the fixed pulley 14 in the resetting assembly, the force of the relative slipping between the first main body 11 and the second main body 12 is delivered to the fixed pulley 14 via the elastic rope 13; by increasing the stress point on the elastic rope 13, the stability of the structure and the reliability in use are enhanced, and the pulling force can be effectively dispersed, thus avoiding the problem of stress concentration caused by the pulling force concentration in the traditional design, and providing an additional elastic reaction. As a result, the two ends of the elastic rope 13 are connected more firmly to prevent slipping or loosening; in particular, when it is subjected to a large external force, the stretching space and connection mode of the elastic rope 13 enable the product to have a greater pulling load capacity, significantly improving the durability and service life of the product, and also improving the practicality of the fitness equipment.

Through the design of this resetting assembly, the worker can use the elastic rope 13 with different lengths according to different users, so that the reset force of the second main body 12 relative to the first main body 11 can be adjusted according to the user's using requirements, increasing the practicality of the product. The traditional technology usually connects the two ends of the elastic rope 13 directly, which not only easily leads to the pulling force concentrated at a certain fixed point, thereby inducing local stress concentration and increasing the risk of equipment damage, but also limits the length of the clastic rope 13. This makes it impossible to adjust the resetting elastic force according to different use requirements, thus making it impossible to adapt to the use population with different requirements. However, the connection mode of the elastic rope 13 passing around the fixed pulley 14 in this design enables the product to have a greater stretching load capacity, significantly improving the durability and service life of the product, and also improving the practicality of the fitness equipment.

Figure 4:
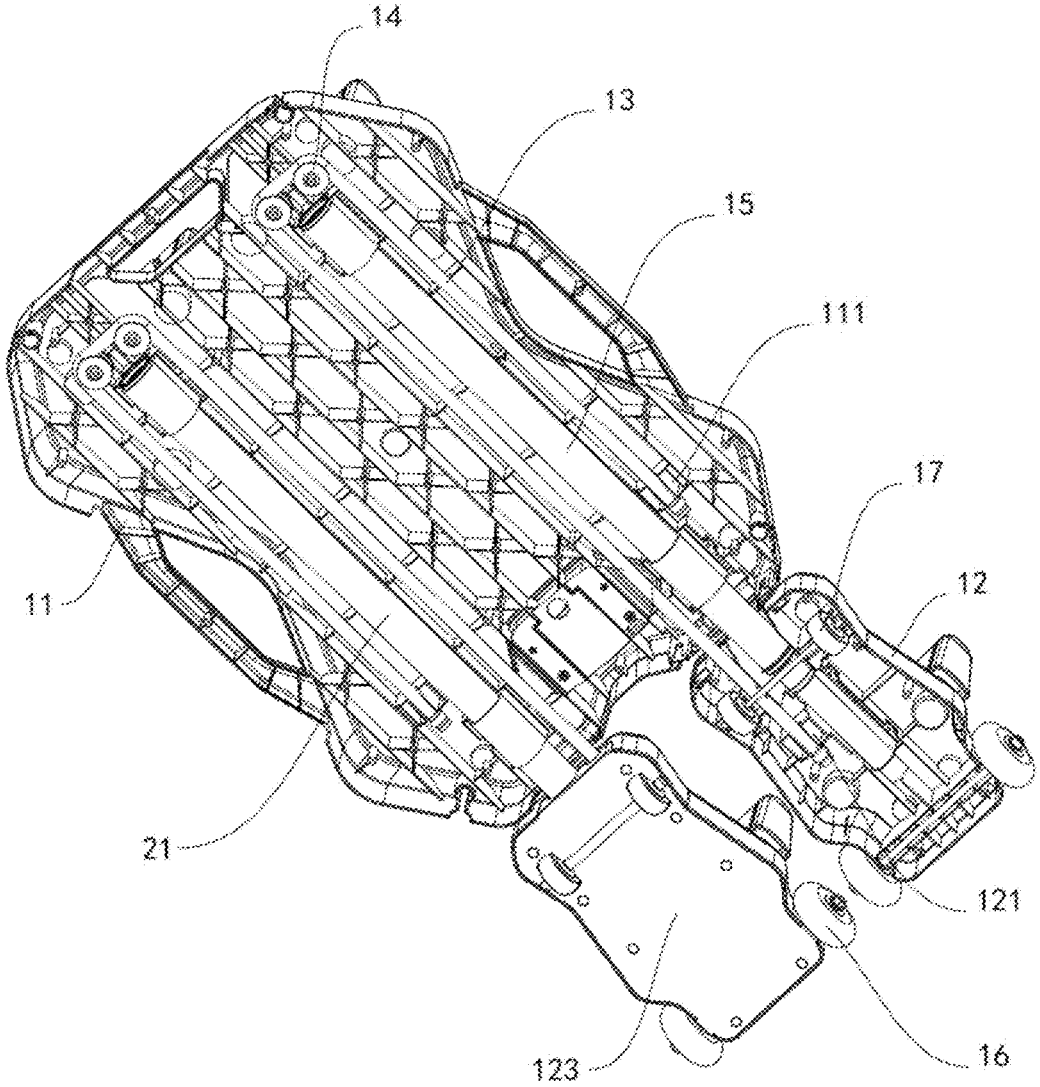
FIG. 4 is a schematic view of a highlighted resetting assembly of fitness equipment according to the present invention.
Figure 8:
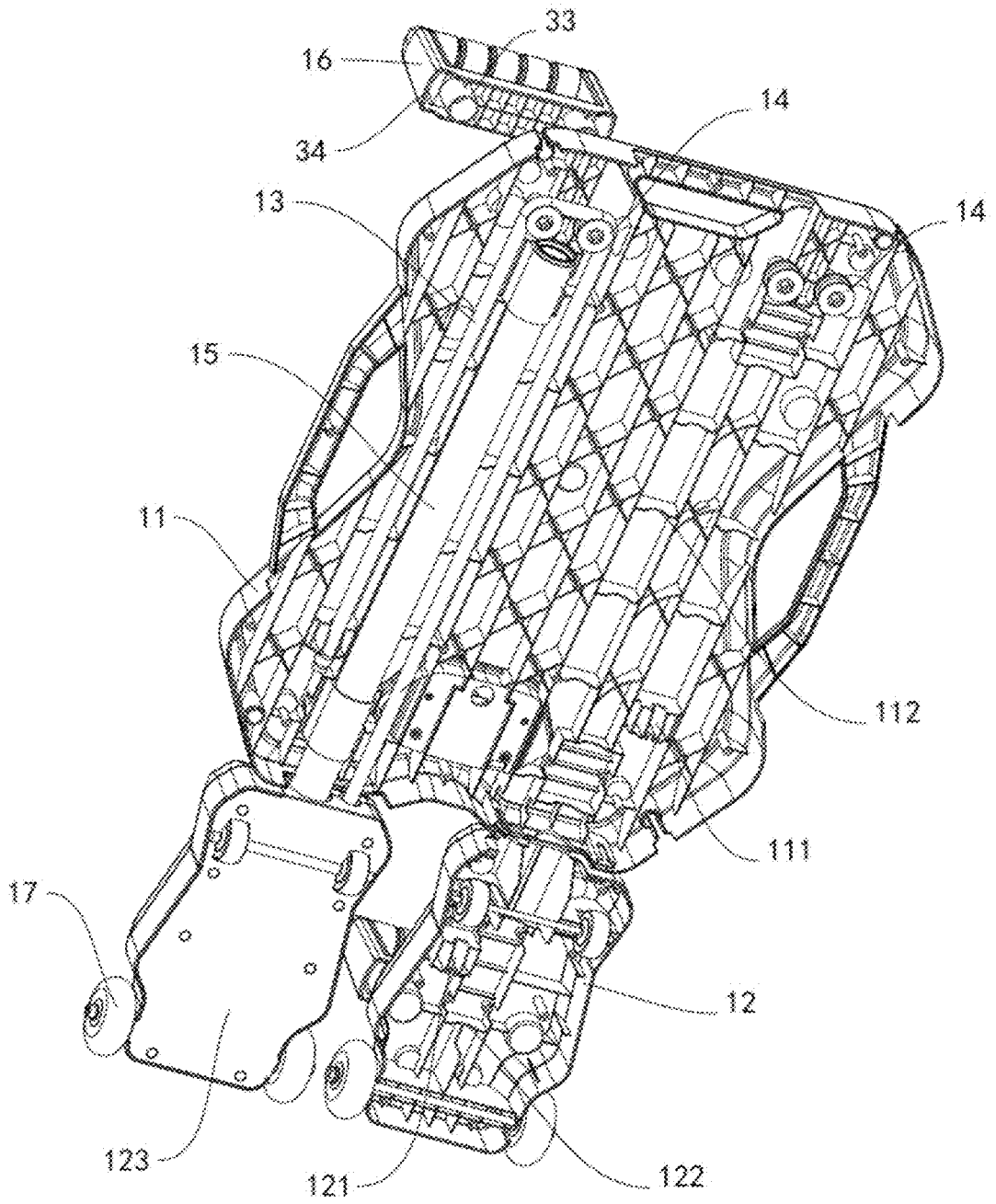
FIG. 8 is a schematic view of fitness equipment highlighting features of the underside of a first main body and a second main body according to the present invention.
Figure 9:
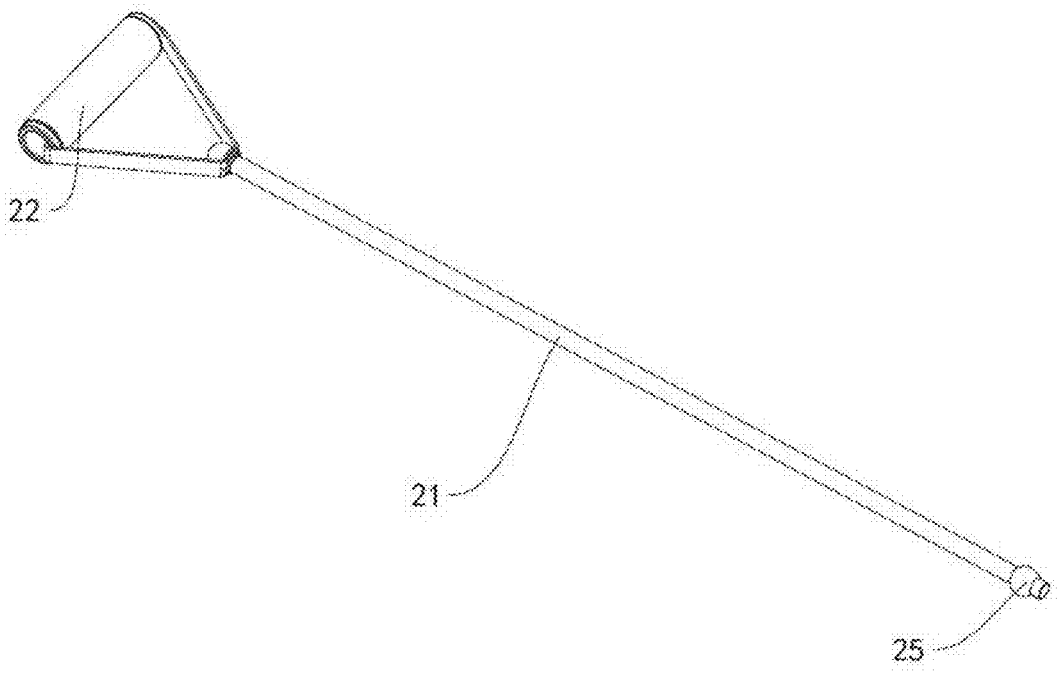
FIG. 9 is a schematic view of a highlighted stretching member of fitness equipment according to the present invention.

Referring to FIGS. 4 and 8, a telescopic member 15 is provided between the first main body 11 and the second main body 12, and the elastic rope 13 passes around the fixed pulley 14 with the telescopic member as a center.

The stable slipping between the first main body 11 and the second main body 12 is achieved by the mutual nesting of the several sleeves in the telescopic member, which not only enhances the connection strength between the first main body 11 and the second main body 12, but also ensures their stability during use, avoiding unnecessary shaking or unstable feeling caused by a weak connection. Among other things, the telescopic member may be of a structurally stable type, such as sleeve-type, piston-type, etc. Through the structure of the telescopic member, the user can experience a smoother and more reliable experience, and it ensures that the stability and safety of the whole equipment system are guaranteed during exercise.

With reference to FIG. 4 and FIG. 8, a first limiting member 111 and a first limiting groove 112 are both provided on the first main body 11, a second limiting member 121 and a second limiting groove 122 are both provided on the second main body 12, the first main body 11 is integrally injection-molded with the first limiting member 111 and the first limiting groove 112, the second main body 12 is integrally injection-molded with the second limiting member 121 and the second limiting groove 122. The technical features on the first main body 11 and the second main body 12 are injection-molded at one time by means of an injection mold. The two ends of the telescopic member 15 are respectively embedded in the first limiting groove 112 and the second limiting groove 122; both the first limiting member 111 and the second limiting member 121 are provided with a notch for fixing the elastic rope 13; the notch is able to cope with a deformation action force with a greater action force by thickening the thickness of the notch; and the two ends of the elastic rope 13 are respectively embedded in the first limiting member 111 and the second limiting member 121.

By means of the integrated injection molding design of the first limiting member 111 and the second limiting member 121, when the elastic rope 13 is assembled, no additional connecting components are needed, and the difficulty of component assembly and disassembly and additional component procurement costs are reduced, so that a worker can more easily confirm and fix the installation position of the elastic rope 13, and the assembly efficiency of the product is accelerated. At the same time, the first limiting groove 112 and the second limiting groove 122 are adhered to the outer side surface of the telescopic member 15, so that the installation position of the telescopic member 15 is defined, and an installation instruction is given to a worker or a user, making it more convenient for workers to disassemble and assemble the telescopic member 15, and making the telescopic member 15 more stable when subjected to a stress as well. In addition, the first main body 11 is integrally injection-molded with the first limiting member 111 and the first limiting groove 112, and the second main body 12 is integrally injection-molded with the second limiting member 121 and the second limiting groove 122. As long as the injection mold is set, the product can be quickly produced, the product yield is improved, and the production efficiency is improved. In addition, the strengths of the first main body 11 and the second main body 12 themselves are also enhanced by the integral injection molding, so that the two have a greater load-bearing force and are resistant to wear, thereby improving the service life and improving the user experience.

With reference to FIGS. 1 to 4 and FIG. 8, a first limiting base plate 113 used for preventing the elastic rope 13 from leaving the first limiting member 111 and the telescopic member 15 from leaving the first limiting groove 112 is provided on the lower side of the first main body 11, a second limiting base plate 123 used for preventing the elastic rope 13 from leaving the second limiting member 121 and the telescopic member 15 from leaving the second limiting groove 122 is provided on the lower side of the second main body 12, and the first limiting base plate 113 and the second limiting base plate 123 are fixedly connected to the first main body 11 and the second main body 12 respectively;

In this embodiment, the first limiting base plate 113 and the second limiting base plate 123 are fitted with the features of the lower side edge portions of the first main body 11 and the second main body 12, respectively, so that the first limiting base plate 113 and the second limiting base plate 123 can limit the telescopic member 15, further improving the connection strength of the telescopic member 15 with the first main body 11 and the second main body 12. Therefore, the product can be more stable in use, and the first limiting base plate 113 and the second limiting base plate 123 can also improve the aesthetic appearance of the product as a whole, making the product more in line with the preferences of the current purchasing population, and improving the economic efficiency of the product.

Figure 5:
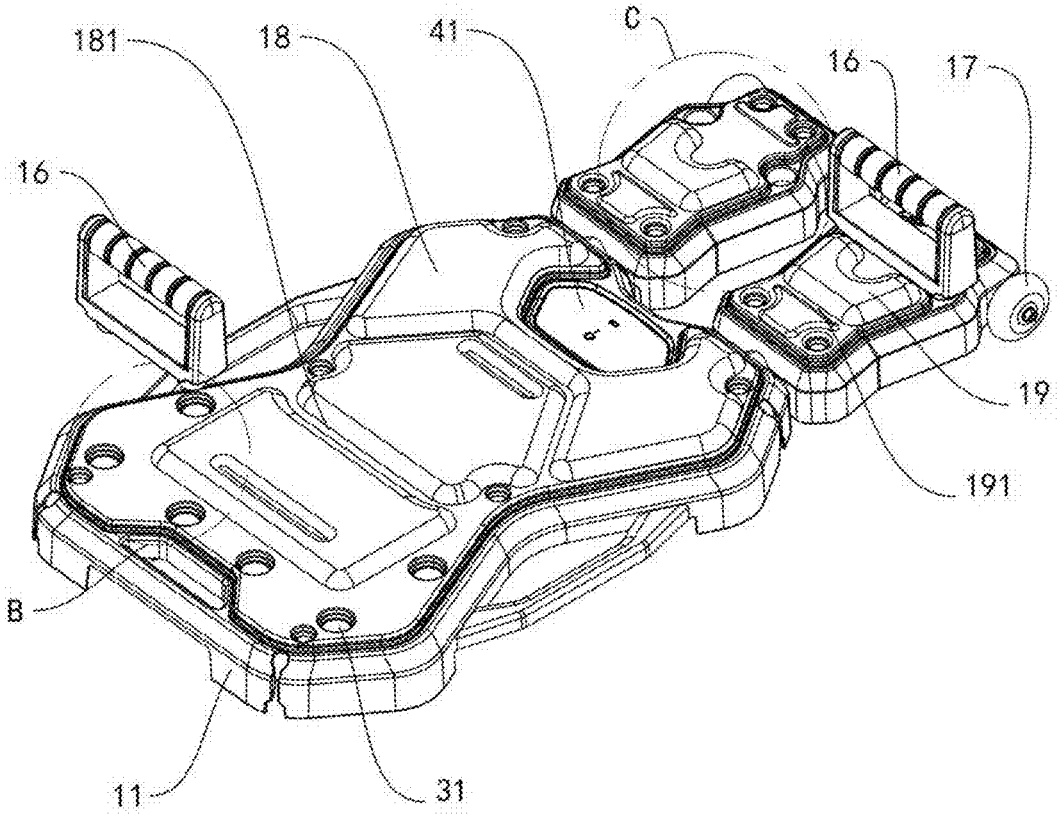
FIG. 5 is a schematic exploded view of fitness equipment according to the present invention.
Figure 6:
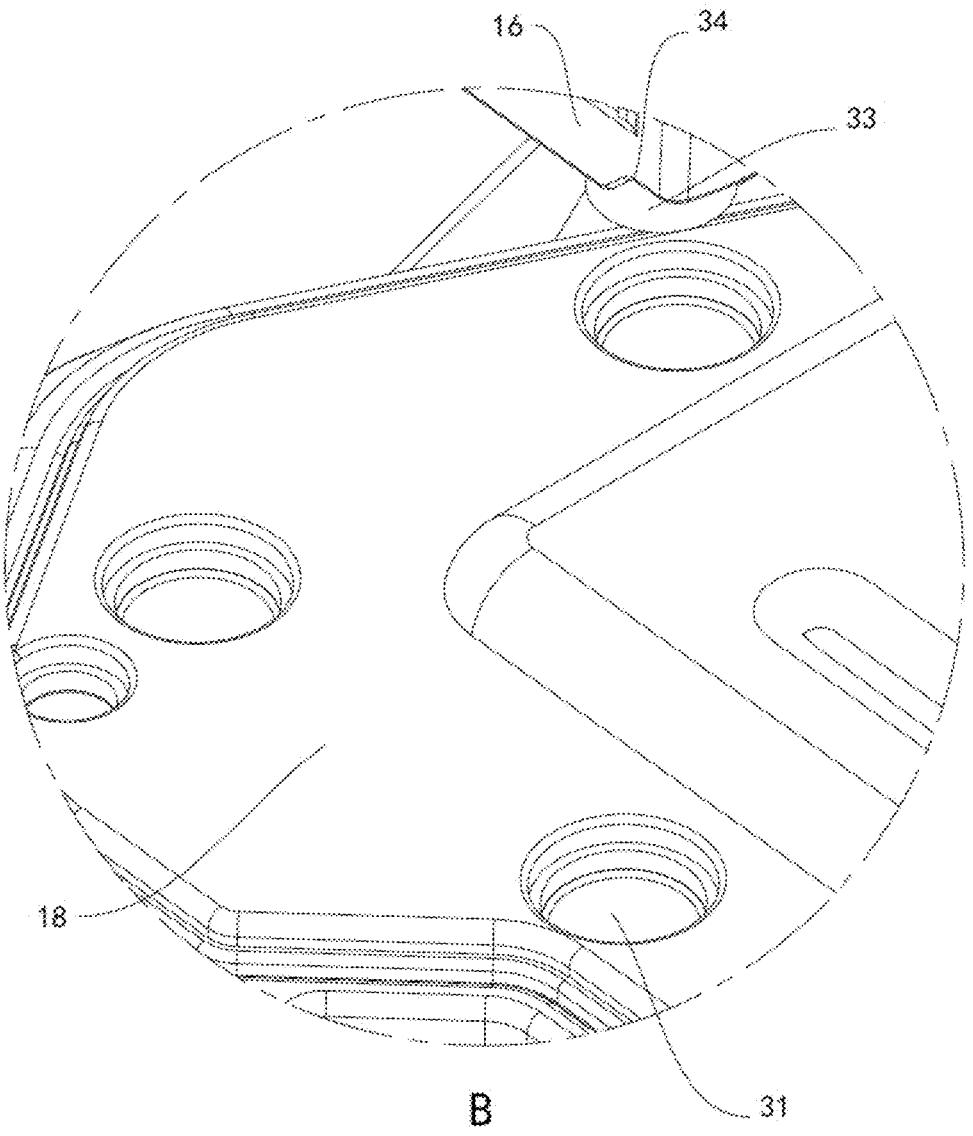
FIG. 6 is an enlarged schematic view at B in FIG. 5.
Figure 7:
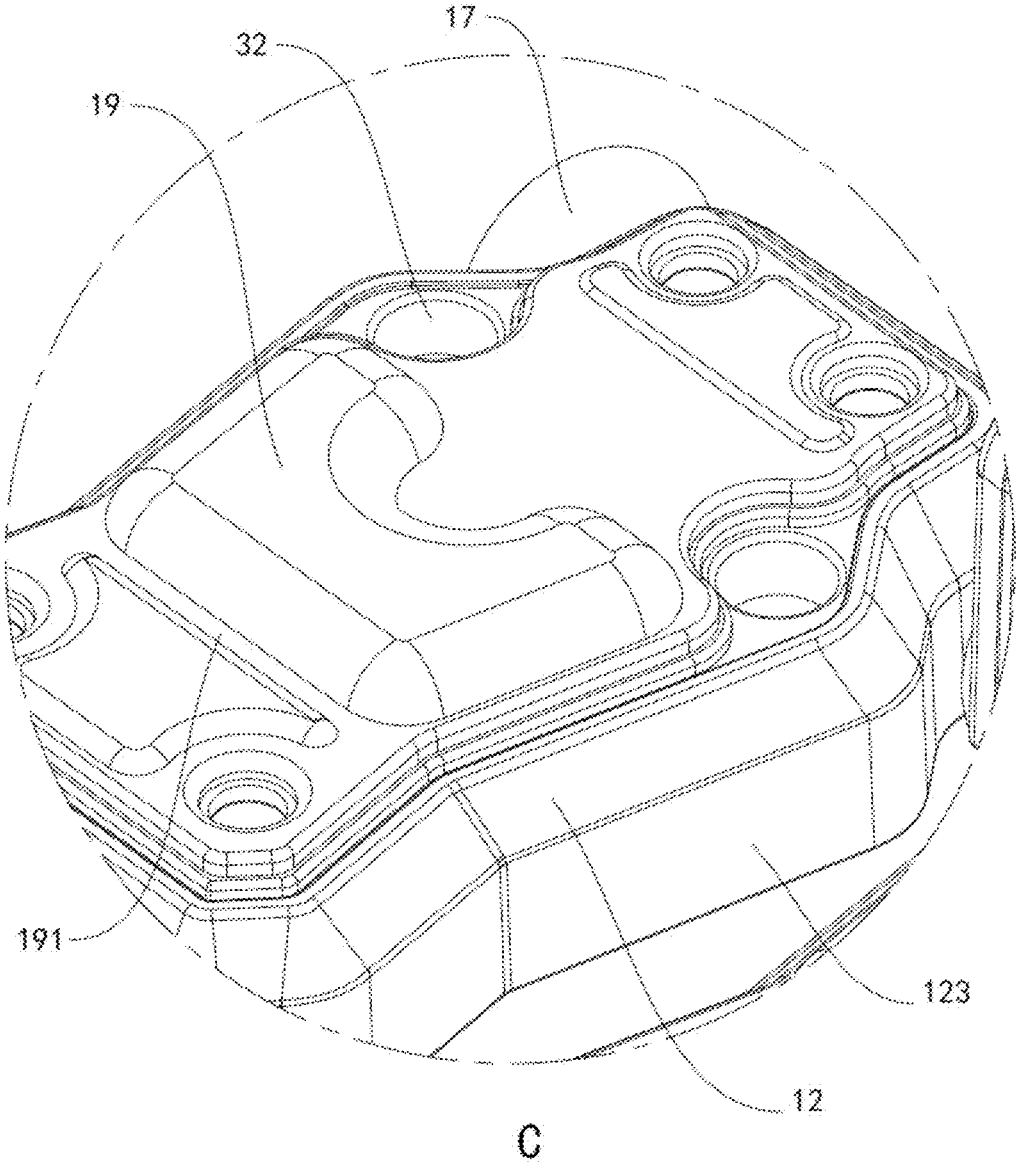
FIG. 7 is an enlarged schematic view at C in FIG. 5.

With reference to FIGS. 5 to 7, several first insertion holes 31 and several second insertion holes 32 are respectively provided on the first main body 11 and the second main body 12, comprising several first handles 16 which can be inserted into the first insertion holes 31 or the second insertion holes 32. At least two insertion columns 33 used for matching with the first insertion hole 31 or the second insertion hole 32 are both fixedly connected to the lower side of the first handle 16, and an annular groove 34 used for improving the convenience of installation and removal of the equipment is provided on the lower side of the first handle 16 near the insertion column 33.

Therefore, the first handle 16 can be inserted with two first insertion holes 31 which are combined at different positions, so as to facilitate the adjustment of various movement postures, increase the use diversity of fitness equipment, and thus can effectively exercise different muscle groups of the body, thereby improving the practicability of the equipment;

and the arrangement of the annular groove 34 not only makes the fitting of the insertion column 33 with the first insertion hole 31 or the second insertion hole 32 clearer and more visible, and facilitates the user's operation, but also effectively reduces the resistance when inserting and pulling. In use, the annular groove 34 enables the user to more easily complete the inserting and pulling actions. In particular, when the inserting and pulling is performed through the lever principle, the excessive force on the connection point on one side is reduced, the wear between the first handle 16 and the first main body 11 is reduced, and the force-effect transmission during the inserting and pulling is improved, so as to ensure that the user can conveniently observe the inserting and pulling state of the first handle 16, thereby further improving the convenience of the installation and removal of the equipment, and enhancing the overall use experience.

With reference to FIGS. 1 to 4, the second main body 12 is provided with a slipping wheel group, the slipping wheel group comprises at least two coaxially arranged slipping wheels 17, the two slipping wheels 17 are respectively located at two sides of the second main body 12, the slipping wheel group has at least two groups, and the outer diameter of the slipping wheel 17 on the slipping wheel group away from the first main body 11 is greater than the slipping wheel 17 on the slipping wheel group close to the first main body 11.

By the addition of the slipping wheel group, the slipping of the second main body 12 with respect to the first main body 11 is more stable, and the user can also generate force more stably when exercising. In addition, when the product is carried, it can also contact the ground via the two groups of slipping wheels 17 on the lower side, so that the fitness equipment can be easily transferred, thus greatly reducing the labor intensity of the user. By the design of the slipping wheel 17, the user can easily push the equipment, avoiding the additional burden in the process of carrying. In addition, the larger wheel diameter is located on the rear side, so compared with the design of the same wheel diameter, it has stronger traction and better slipping speed control which enables the slipping wheel 17 to more smoothly control the slipping process during use, thereby reducing the risk of accidents due to excessive speed or instability, further enhancing the overall stability of use, and improving the comfort and safety of the user when exercising.

Referring to FIG. 1 and FIG. 8, the telescopic member 15 has a rod-like structure, and the fixed pulley 14 has at least two fixed pulleys 14 positioned at one end of the telescopic member 15 away from the second main body 12, respectively, and symmetrically disposed about the axis of the telescopic member 15.

The telescopic members 15 with different telescopic sizes can be adapted according to the first main body 11 and the second main body 12 with different plate cuts, and then the number of the fixed pulleys 14 is increased and decreased, so that the elastic rope 13 can be elastically required to wrap different numbers of the fixed pulleys 14. Because the wrapping structure of the elastic rope 13 and the fixed pulley 14 can effectively disperse the tensile force and increase the stress points, it avoids the stress concentration problem caused by the tensile force concentration in the traditional design, thereby not only providing an additional elastic reaction, but also more evenly distributing the tensile force and the pressure, and thus making the connection of the two ends of the elastic rope 13 more secure and preventing slipping or loosening. At that, users can select telescopic members 15 with different telescopic sizes and elastic ropes 13 with different lengths according to their different heights, thereby improving the practicability and adaptability. At the same time, users with the same height will also have different requirements for elastic reset assistance; and the number of fixed pulleys 14 can be adjusted according to requirements, so as to control the elastic function of elastic ropes 13, thereby further improving the practicability.

Referring to FIG. 1 and FIGS. 5 to 7, a first cushion 18 covers the surface of the first main body 11, a second cushion 19 covers the surface of the second main body 12, and a plurality of first intermittent grooves 181 and a plurality of second intermittent grooves 191 are respectively formed on the surfaces of the first cushion 18 and the second cushion 19.

The provision of the first intermittent groove 181 and the second intermittent groove 191 helps to reduce the pressure when the cushion contacts the body during exercise, especially in the joint parts, such as the knee, elbow, etc., thereby effectively alleviating discomfort and avoiding the pain caused by excessive compression. In addition, the provision of the groove positions of the first intermittent groove 181 and the second intermittent groove 191 can also guide the posture of the user, helping the user to maintain the correct posture when using the equipment, and preventing slipping or dislocation. At the same time, the design of the intermittent groove also plays a role in promoting the circulation of air, thereby reducing the accumulation of overheating or sweat on the surface of the cushion, greatly improving the ventilation effect and keeping the skin dry, thus improving the overall use experience, especially during long-term exercise, avoiding the discomfort caused by humidity and mugginess, and increasing the comfort and practicality of the equipment.

Embodiment 2

This embodiment improves the exercise mode of this product on the basis of embodiment 1.

With reference to FIGS. 1 to 4 and 8, a stretching member 21 is detachably and fixedly connected to a first main body 11, one end of the stretching member is fixedly connected to a second handle 22, a pulling groove 23 is provided at the edge of the first main body 11, a locking groove 24 is provided at the lower side of the pulling groove 23, a limiting protrusion 25 is provided at one end of the stretching member, and the limiting protrusion 25 passes around the pulling groove 23 and is locked with the locking groove 24.

At that, a user can do some additional exercise actions, such as flying birds, by passing the limiting protrusion 25 at one end of the stretching member 21 around the pulling groove 23 and clamping the same with the locking groove 24, and then holding the second handle 22, thereby adding various exercise modes, and further improving the practicality of the product.

Embodiment 3

This embodiment improves the transmission relationship between the first main body 11 and the second main body 12 on the basis of embodiment 1.

Referring to FIGS. 1 and 5, a digital display screen 41 for displaying the number of actions or time, and a battery module for supplying power to the digital display screen 41 are embedded on the first main body 11, and a charging interface for charging the battery module is provided on the surface of the digital display screen 41.

The setting of the digital display screen 41 enables the user to conveniently view and know his or her current exercise progress, and key information such as exercise time or number of action groups. By providing real-time exercise data directly on the fitness equipment, the inconvenience that users need to rely on additional digital products (such as mobile phones or watches) to record data is reduced, the use process is greatly simplified, so that users are not easily distracted by digital products during exercise, can be more invested in exercising. At that, users can more intuitively understand their exercise situation, and monitor the progress in the exercise process in real-time, and then make adjustments according to the displayed data. Through the clear display of the exercise time and the number of groups, the user can optimize the training plan according to the actual exercise effect, thereby ensuring that the exercise effect reaches the best state, so as to improve the efficiency and pertinence of the exercise.

The same or similar reference numbers in the accompanying drawings of the embodiments correspond to the same or similar components. In the description of this application, it should be understood that if there are terms such as "up", "down", "left", "right" indicating orientation or positional relationships based on the orientation or positional relationships shown in the accompanying drawings, and that is only for the convenience of describing this application and simplifying the description, and does not indicate or imply that the device or element referred to or implied must have a specific orientation, or be constructed and operated in a specific orientation. Therefore, the language used to describe positional relationships in the accompanying drawings is only for illustrative purposes and cannot be understood as a limitation of this patent. For ordinary technical personnel in this field, the specific meanings of the above terms can be understood according to specific situations.

The above are only preferred embodiments of the application, and are not intended to limit the application. Any modification, equivalent replacement and improvement, and the like made within the spirit and principle of the application shall be included in the protection scope of the application.

The invention claimed is:

1. A fitness equipment, comprising:

a first main body (11), and a second main body (12) reciprocally movable with respect to the first main body (11);

a resetting assembly, the resetting assembly comprising an elastic rope (13) and a fixed pulley (14), wherein the fixed pulley (14) is rotatably connected to the first main body (11), a first end of the elastic rope (13) is fixedly connected to the first main body (11), and a second end of the elastic rope (13) passes around the fixed pulley (14) and is fixedly connected to the second main body (12); and a telescopic member (15), provided between the first main body (11) and the second main body (12), wherein the elastic rope (13) passes around the fixed pully (14) with the telescopic member at a center position thereof.

2. The fitness equipment according to claim 1, wherein the first main body (11) is provided with a first limiting member (111) and a first limiting groove (112), the second main body (12) is provided with a second limiting member (121) and a second limiting groove (122), the first main body (11) is integrally injection-molded with the first limiting member (111) and the first limiting groove (112), and the second main body (12) is integrally injection-molded with the second limiting member (121) and the second limiting groove (122):

two ends of said telescopic member (15) are respectively embedded in the first limiting groove (112) and the second limiting groove (122); and the first limiting member (111) and the second limiting member (121) are both provided with notches for fixing the elastic rope (13), and the first and second ends of the elastic rope (13) are respectively embedded in the first limiting member (111) and the second limiting member (121).

3. The fitness equipment according to claim 2, wherein the first main body (11) is provided with a first limiting base plate (113) for preventing the elastic rope (13) from being separated from the first limiting member (111) and the telescopic member (15) from being separated from the first limiting groove (112):

the second main body (12) is provided with a second limiting base plate (123) for preventing the elastic rope (13) from being separated from the second limiting member (121) and the telescopic member (15) from being separated from the second limiting groove (122); and the first limiting base plate (113) and the second limiting base plate (123) are fixedly connected to the first main body (11) and the second main body (12), respectively.

4. The fitness equipment according to claim 2, wherein the telescopic member (15) has a rod-like structure, and the fixed pully (14) is at least two fixed pulleys (14); and the at least two fixed pulleys (14) are located at one end of the telescopic member (15) away from the second main body (12), and are symmetrically arranged with an axis of the telescopic member (15) at a center therebetween.

5. The fitness equipment according to claim 1, wherein a stretching member (21) is detachably and fixedly connected to the first main body (11), a handle (22) is fixedly connected to a first end of the stretching member, a pulling groove (23) is provided at an edge of the first main body (11), a locking groove (24) is provided on a lower side of the pulling groove (23), a limiting protrusion (25) is provided at a seconded of the stretching member, and the limiting protrusion (25) passes around the pulling groove (23) and is clamped with the locking groove (24).

6. The fitness equipment according to claim 1, wherein the first main body (11) is provided thereon with a plurality of first insertion holes (31):

wherein the second main body (12) is provided thereon with a plurality of second insertion holes (32);

wherein the fitness equipment further comprises a plurality of several first handles (16), wherein at least two insertion columns (33) for insertably mating with the plurality of first insertion holes (31) or the plurality of second insertion holes (32), respectively, are fixedly connected to a lower side of each of the plurality of first handles (16); and wherein the lower side of each of the plurality of first handles (16) near each insertion column (33) is provided with an annular groove (34) for improving a convenience of installation and removal of the respective first handle (16).

7. The fitness equipment according to claim 1, wherein the second main body (12) is provided with a first slipping wheel group located remote from the first main body (11) and a second slipping wheel group located close to the first main body (11), each of the first and second slipping wheel groups comprising two coaxially arranged slipping wheels (17) respectively located on two sides of the second main body (12), wherein an outer diameter of each of the two coaxially arranged slipping wheels (17) of the first slipping wheel group is larger than an outer diameter of each of the two coaxially arranged slipping wheels (17) of the second slipping wheel group.

8. The fitness equipment according to claim 1, wherein a first cushion (18) covers a top surface of the first main body (11), a second cushion (19) covers a top surface of the second main body (12); and a plurality of first intermittent grooves (181) are provided on a top surface of the first cushion (18), and a plurality of second intermittent grooves (191) are provided on a top surface of the second cushion (19).

9. The fitness equipment according to claim 1, wherein the first main body (11) is embedded with a digital display screen (41) for displaying a number of actions or time and a battery module for supplying power to the digital display screen (41); and a surface of the digital display screen (41) is provided with a charging interface for charging the battery module.

10. A fitness equipment, comprising:

a first main body (11), and a second main body (12) reciprocally movable with respect to the first main body (11), wherein the first main body (11) is provided thereon with a plurality of first insertion holes (31), and the second main body (12) is provided thereon with a plurality of second insertion holes (32);

a resetting assembly, the resetting assembly comprising an elastic rope (13) and a fixed pulley (14), wherein the fixed pulley (14) is rotatably connected to the first main body (11), a first end of the elastic rope (13) is fixedly connected to the first main body (11), and a second end of the elastic rope (13) passes around the fixed pulley (14) and is fixedly connected to the second main body (12); and a plurality of first handles (16), wherein at least two insertion columns (33) for insertably mating with the plurality of first insertion holes (31) or the plurality of second insertion holes (32), respectively, are fixedly connected to a lower side of each of the plurality of first handles (16); and wherein the lower side of each of the plurality of first handles (16) near each insertion column (33) is provided with an annular groove (34) for improving a convenience of installation and removal of the respective first handle (16).

11. A fitness equipment, comprising:

a first main body (11), and a second main body (12) reciprocally movable with respect to the first main body (11); and a resetting assembly, the resetting assembly comprising an elastic rope (13) and a fixed pulley (14), wherein the fixed pulley (14) is rotatably connected to the first main body (11), a first end of the elastic rope (13) is fixedly connected to the first main body (11), and a second end of the elastic rope (13) passes around the fixed pulley (14) and is fixedly connected to the second main body (12);

wherein the second main body (12) is provided with a first slipping wheel group located remote from the first main body (11) and a second slipping wheel group located close to the first main body (11), each of the first and second slipping wheel groups comprising two coaxially arranged slipping wheels (17) respectively located on two sides of the second main body (12), wherein an outer diameter of each of the two coaxially arranged slipping wheels (17) of the first slipping wheel group is larger than an outer diameter of each of the two coaxially arranged slipping wheels (17) of the second slipping wheel group.

* * * * *